US007520056B2

(12) United States Patent
Arai et al.

(10) Patent No.: US 7,520,056 B2
(45) Date of Patent: Apr. 21, 2009

(54) METHOD AND DEVICE FOR MOLDING WHEEL RIM HUMP PART

(75) Inventors: Koichi Arai, Utsunomiya (JP); Minoru Nakano, Utsunomiya (JP); Kenzo Takeda, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 454 days.

(21) Appl. No.: 10/561,791

(22) PCT Filed: Jun. 22, 2004

(86) PCT No.: PCT/JP2004/008760

§ 371 (c)(1),
(2), (4) Date: Dec. 21, 2005

(87) PCT Pub. No.: WO2004/112984

PCT Pub. Date: Dec. 29, 2004

(65) Prior Publication Data

US 2007/0107223 A1 May 17, 2007

(30) Foreign Application Priority Data

Jun. 23, 2003 (JP) ..... 2003-178481
Jun. 23, 2003 (JP) ..... 2003-178488
Jun. 23, 2003 (JP) ..... 2003-178500
Jun. 23, 2003 (JP) ..... 2003-178507

(51) Int. Cl.
*B21K 1/38* (2006.01)
*B23P 17/00* (2006.01)

(52) U.S. Cl. ..... 29/894.353; 29/894.322; 29/894.323; 29/894.325; 29/894.354; 301/63.107

(58) Field of Classification Search ..... 29/894.322, 29/894.323, 894.325, 894.353, 894.354; 301/63.107

See application file for complete search history.

(56) References Cited

U.S. PATENT DOCUMENTS 5,531,024 A * 7/1996 Lowe et al. ..... 29/894.323
2005/0274015 A1* 12/2005 Tanaka ..... 29/894.354
2006/0123629 A1* 6/2006 Friese ..... 29/894.353

FOREIGN PATENT DOCUMENTS

JP 2-70340 3/1990
JP 2-299733 12/1990
JP 3-5035 1/1991
JP 10-71443 3/1998

* cited by examiner

*Primary Examiner*—David P Bryant
*Assistant Examiner*—Alexander P Taousakis
(74) *Attorney, Agent, or Firm*—Kratz, Quintos & Hanson, LLP

(57) ABSTRACT

A method for molding a wheel rim hump part, comprising the steps of stopping a fist claw (30) and a second claw (32) holding a work (wheel rim for vehicle) (W) at specified positions and allowing an annular support member (160) to abut on the end surface of the curl part (C1) of the work (W), closing a right side first mold (16*b*) to support the curl part (C1) and the outer peripheral wall surface of the work by the support mold (106) of the right side first mold (16*b*), also closing a left side first mold (16*a*) to support the curl part (C1) and the outer peripheral wall surface of the work by the support mold (106) of the left side first mold (16*a*), moving forward a long rod (136) to allow a roller metal mold (124) to abut on the inner peripheral wall surface of the work (W), and turning the roller metal mold (124) along the circumferential direction thereof.

12 Claims, 12 Drawing Sheets

METHOD AND DEVICE FOR MOLDING WHEEL RIM HUMP PART

TECHNICAL FIELD

The present invention relates to a method of and an apparatus for forming a wheel rim hump portion by raising an outer circumferential wall surface of a vehicular wheel rim into a hump portion.

BACKGROUND ART

As a type of wheels for supporting tires required for automobiles to travel on, there have widely been used two-piece wheels comprising a vehicular wheel rim (hereinafter also referred to simply as "rim") in the form of a hollow cylindrical body and a disk inserted in the wheel rim, the wheel rim and the disk being joined to each other by MIG welding or the like.

The rim is manufactured as follows: First, the end faces of an elongate rectangular plate are brought into abutment against each other, and thereafter the abutting end faces are joined to each other by resistance welding or the like, thereby forming a hollow cylindrical body. Then, the hollow cylindrical body is rolled by a multi-step rolling process, forming a recess called a drop portion in a substantially central region of an outer circumferential wall of the hollow cylindrical body. Thereafter, the ends of the hollow cylindrical body are bent into curled portions.

In order to prevent air from leaking out of the tire mounted on the wheel and also to prevent the beads of the type from falling into the drop portion at the center of the rim, hump portions are formed on the hollow cylindrical body, thereby completing the rim.

To form the hump portion, it has been proposed in Patent Document 1 to roughly form a hollow cylindrical workpiece to extend an outer circumferential wall surface thereof, and press a die having a recess against the outer circumferential wall surface to finish the outer circumferential wall surface for thereby further extending the outer circumferential wall surface and causing the material of the outer circumferential wall surface to flow into the recess to raise the outer circumferential wall surface into the hump portion.

Patent Document 2 discloses a process of manufacturing a rim by inserting a first roller having a ridge on a side circumferential wall thereof into a hollow cylindrical body, placing a second roller having a recess outside of the hollow cylindrical body, displacing the first roller and the second roller toward each other, and finally pressing the ridge of the first roller against an inner circumferential wall surface of the hollow cylindrical body to raise an outer circumferential wall surface thereof into a hump portion. The raised outer circumferential wall surface of the hollow cylindrical body enters the recess of the second roller.

A disk is then inserted into the rim thus manufactured, and the disk and the rim are joined to each other by MIG welding or the like, thereby forming a wheel.

Patent Document 1: Japanese Laid-Open Patent Publication No. 10-71443

Patent Document 2: Japanese Laid-Open Patent Publication No. 2-299733

DISCLOSURE OF THE INVENTION

Problems to be Solved by the Invention

The hump portion is required to be of good dimensional accuracy for reliably serving the purpose of preventing air from leaking out of the tire mounted on the wheel. In particular, the outer circumferential wall surface held in contact with the tire is required to keep the numerical values of a radius of curvature and the distance between the apex of the hump portion and the curled portion in predetermined ranges.

It is a general object of the present invention to provide a method of forming a wheel rim hump portion of good dimensional accuracy for producing a wheel which is free of the risk of air leakage from the tire mounted thereon.

A major object of the present invention is to provide a method of easily forming a wheel rim hump portion of good dimensional accuracy.

Another object of the present invention is to provide a wheel rim hump portion forming apparatus for performing the above method of forming a wheel rim hump portion.

Means for Solving the Problems

According to a first aspect of the present invention, there is provided a method of forming a wheel rim hump portion along a circumferential direction on an outer circumferential wall surface of a vehicular wheel rim gripped by gripping means, comprising steps of:

supporting the vehicular wheel rim from the outer circumferential wall surface thereof with a first die having a recess, and pressing the vehicular wheel rim from an inner circumferential wall surface thereof with a ridge disposed on a second die coupled to a rotational shaft at a position corresponding to the recess to raise the outer circumferential wall surface of the vehicular wheel rim;

rotating the rotational shaft to displace the ridge along the circumferential direction on the inner circumferential wall surface of the vehicular wheel rim, thereby raising the outer circumferential wall surface along the circumferential direction to form a hump portion.

Preferably, the first die has another recess different from the recess, and when the vehicular wheel rim is supported from the outer circumferential wall surface thereof, a curled portion on an end of the vehicular wheel rim is accommodated and supported in the other recess.

Preferably, a roller having the ridge projecting from a side circumferential wall thereof is used as the second die.

Preferably, two individually movable plates are provided on the first die, and the method further comprises the steps of placing the vehicular wheel rim on a placement table while the first die is being open, closing one of the movable plates on the first die, and thereafter closing the remaining movable plate to close the first die for thereby supporting the outer circumferential wall surface of the vehicular wheel rim to form the hump portion.

Preferably, the hump portion is formed while holding a support member in abutment against an end face of the curled portion.

According to a second aspect of the present invention, there is provided an apparatus for forming a wheel rim hump portion along a circumferential direction on an outer circumferential wall surface of a vehicular wheel rim gripped by gripping means, comprising:

a placement table for placing the vehicular wheel rim thereon;

a first die having a recess, for supporting the vehicular wheel rim from an outer circumferential surface thereof;

a second die coupled to a rotational shaft and having a ridge at a position corresponding to the recess; and rotating means for rotating the rotational shaft;

wherein the vehicular wheel rim is pressed from an inner circumferential wall surface thereof with the ridge of the second die, and plastically deformed material of the vehicular wheel rim is caused to enter the recess of the first die to raise the outer circumferential wall surface of the vehicular wheel rim; and wherein the rotational shaft is rotated to displace the ridge along the circumferential direction on the inner circumferential wall surface of the vehicular wheel rim, thereby raising the outer circumferential wall surface along the circumferential direction to form a hump portion.

Preferably, in the apparatus, the first die has another recess different from the recess. When the vehicular wheel rim is supported from the outer circumferential wall surface thereof, a curled portion on an end of the vehicular wheel rim is supported in the other recess.

Preferably, the second die comprises a roller having the ridge projecting from a side circumferential wall thereof.

Preferably, the apparatus further comprises reversing means for reversing the gripping means.

Preferably, in the apparatus, the first die has two movable plates which are movable independently of each other, and after one of the movable plates of the first die is closed, the remaining movable plate is closed to close the first die for thereby supporting the outer circumferential wall surface of the vehicular wheel rim which is placed on the placement table while the first die is being open, and then the hump portion is formed.

Preferably, the apparatus further comprises fixing means for positioning and fixing the first die which is closed.

Preferably, a pressing force applied to the one of the movable plates is greater than a pressing force applied to the remaining movable plate.

Preferably, the apparatus further comprises a support member for supporting the curled portion from an end face thereof, and support member displacing means for displacing the support member. In the apparatus, the hump portion is formed while the support member is being held in abutment against the end face of the curled portion.

BEST MODE FOR CARRYING OUT THE INVENTION

A preferred embodiment of a method of forming a wheel rim hump portion according to the present invention will be described in detail below in relation to a wheel rim hump portion forming apparatus with reference to the accompanying drawings.

Figure 1:
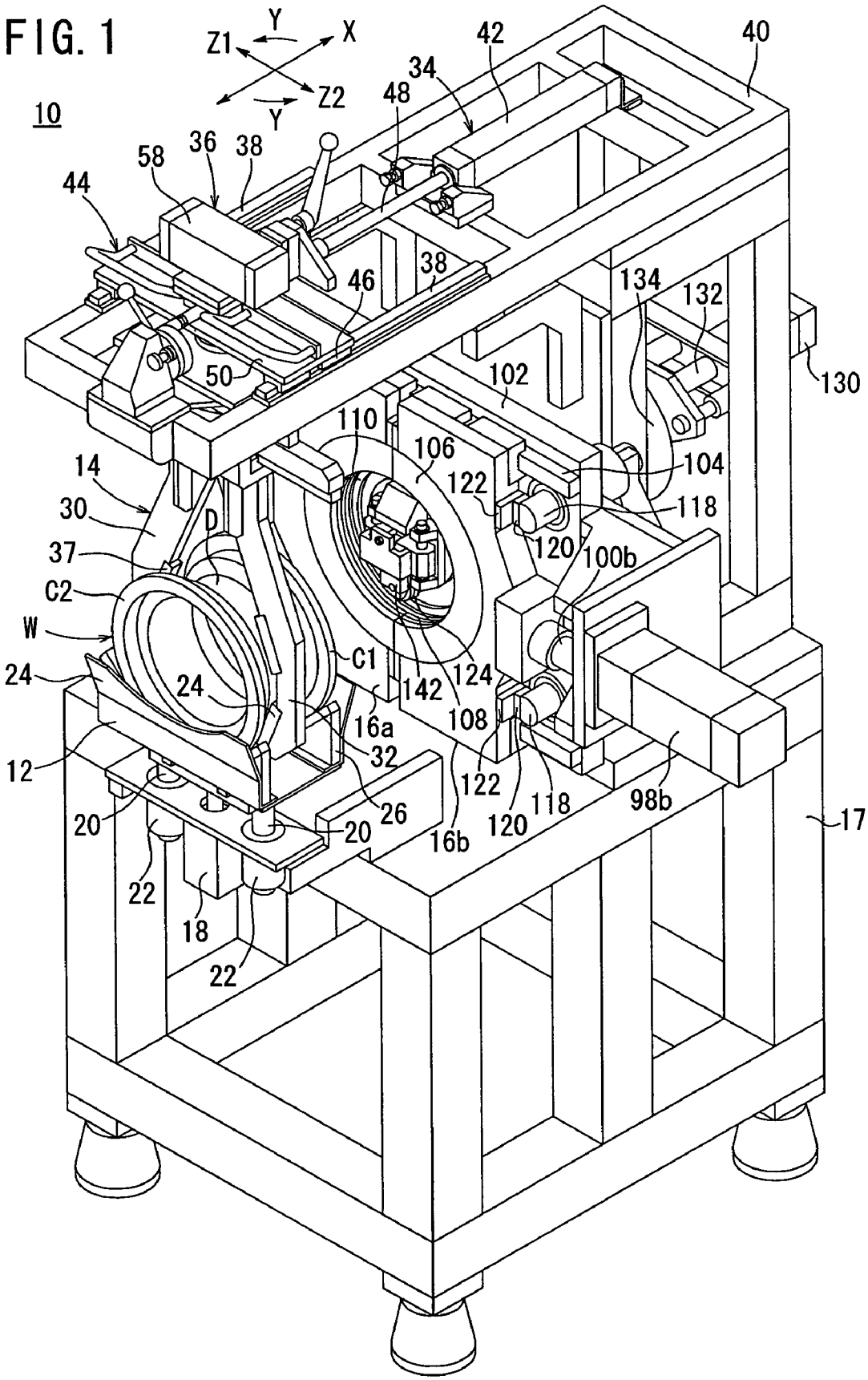
FIG. 1 is a schematic perspective view of an overall hump portion forming apparatus for performing a method of forming a wheel rim hump portion according to an embodiment of the present invention.

First, the wheel rim hump portion forming apparatus (hereinafter referred to simply as "hump portion forming apparatus") will be described below. As shown in overall schematic perspective in FIG. 1, schematic side elevation in FIG. 2, and schematic front elevation in FIG. 3, the wheel rim hump portion forming apparatus 10 has a placement table 12 for placing thereon a rim (hereinafter also referred to as "workpiece"), which has a drop portion D and curled portions C1, C2 and is free of hump portions, a clamp means 14 as a gripping means for gripping the workpiece W, and a left first die 16*a* (movable plate) and a right first die 16*b* (movable plate) for pressing the workpiece W from its outer circumferential wall surface. These components are supported on a base 17.

Figure 2:
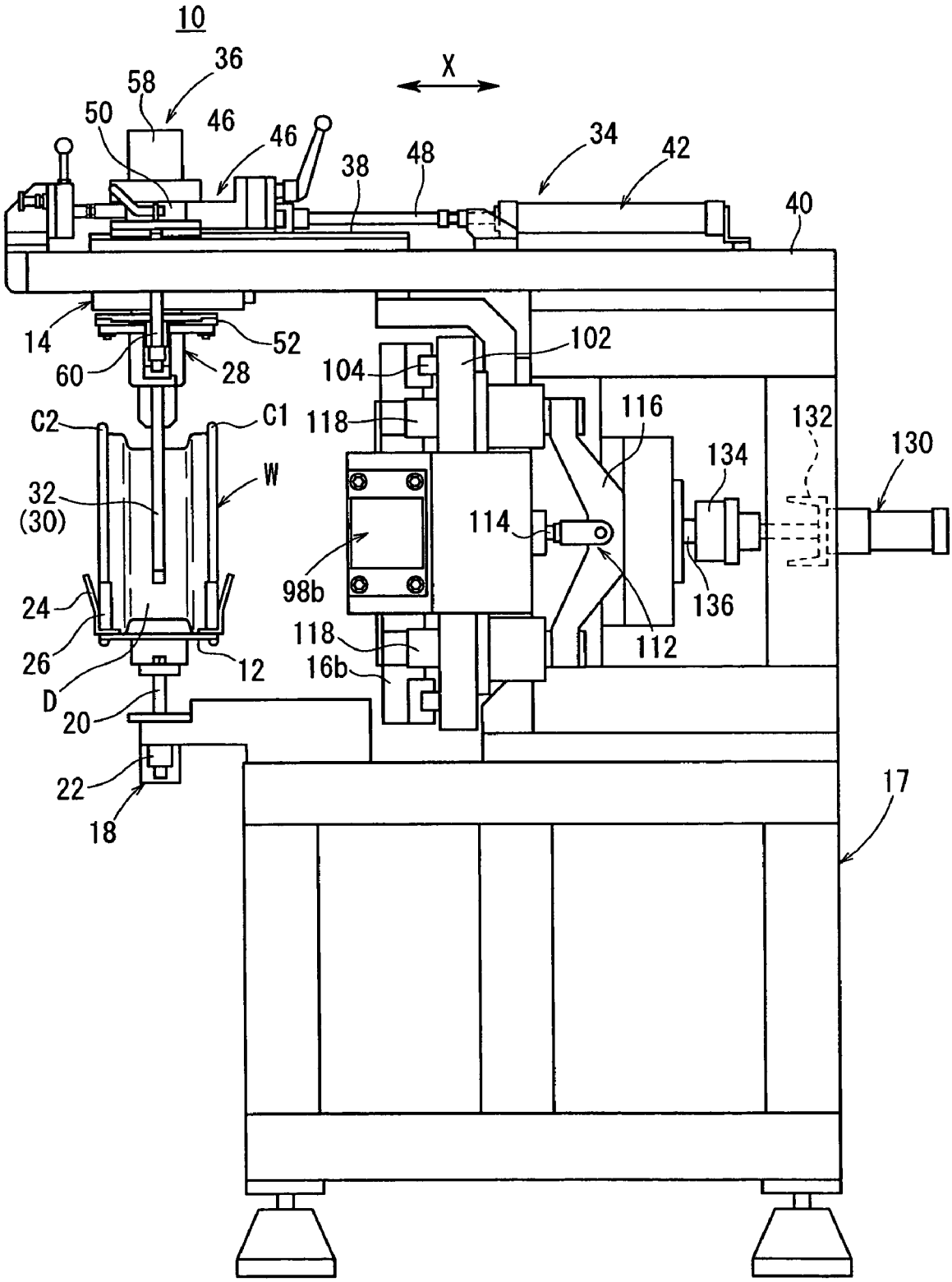
FIG. 2 is a schematic side elevational view of the hump portion forming apparatus shown in FIG. 1.
Figure 3:
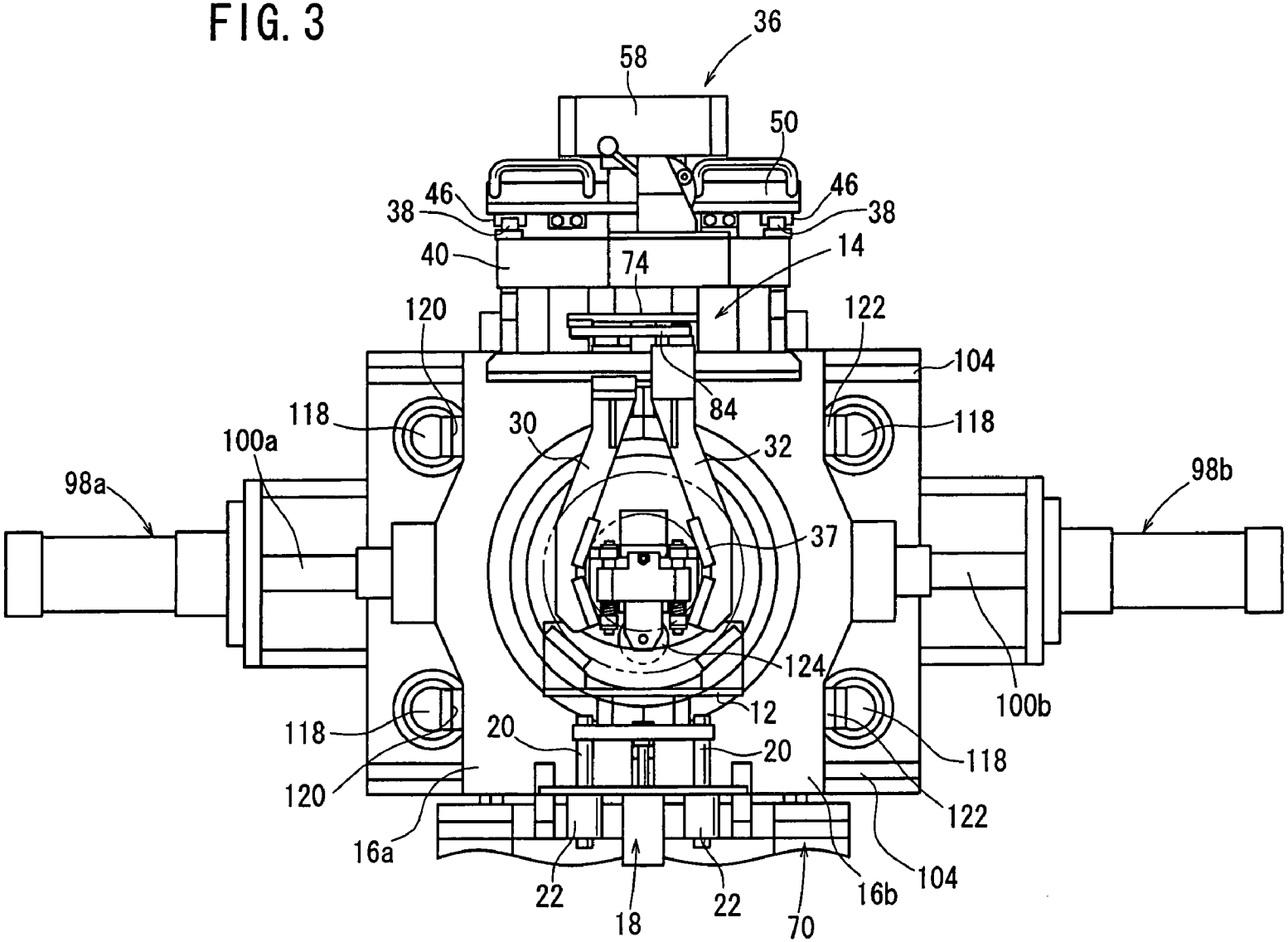
FIG. 3 is a schematic front elevational view of the hump portion forming apparatus shown in FIG. 1.

The placement table 12 is mounted on a left end of the base 17 as shown in FIG. 2 by a placement table lifting and lowering cylinder 18, and can be lifted and lowered by the placement table lifting and lowering cylinder 18. Guide rods 20 are disposed on left and right sides of the placement table lifting and lowering cylinder 18. The guide rods 20 are slid through respective through holes in guide bushes 22 to avoid being tilted when the placement table 12 is lifted and lowered.

The placement table 12 has upstanding walls 24 on peripheral edges thereof. Support frames 26 are removably mounted on the placement table 12 near inner wall surfaces of the upstanding walls 24. The upstanding walls 24 and the support frames 26 prevent the workpiece W from being dislodged from the placement table 12.

Figure 4:
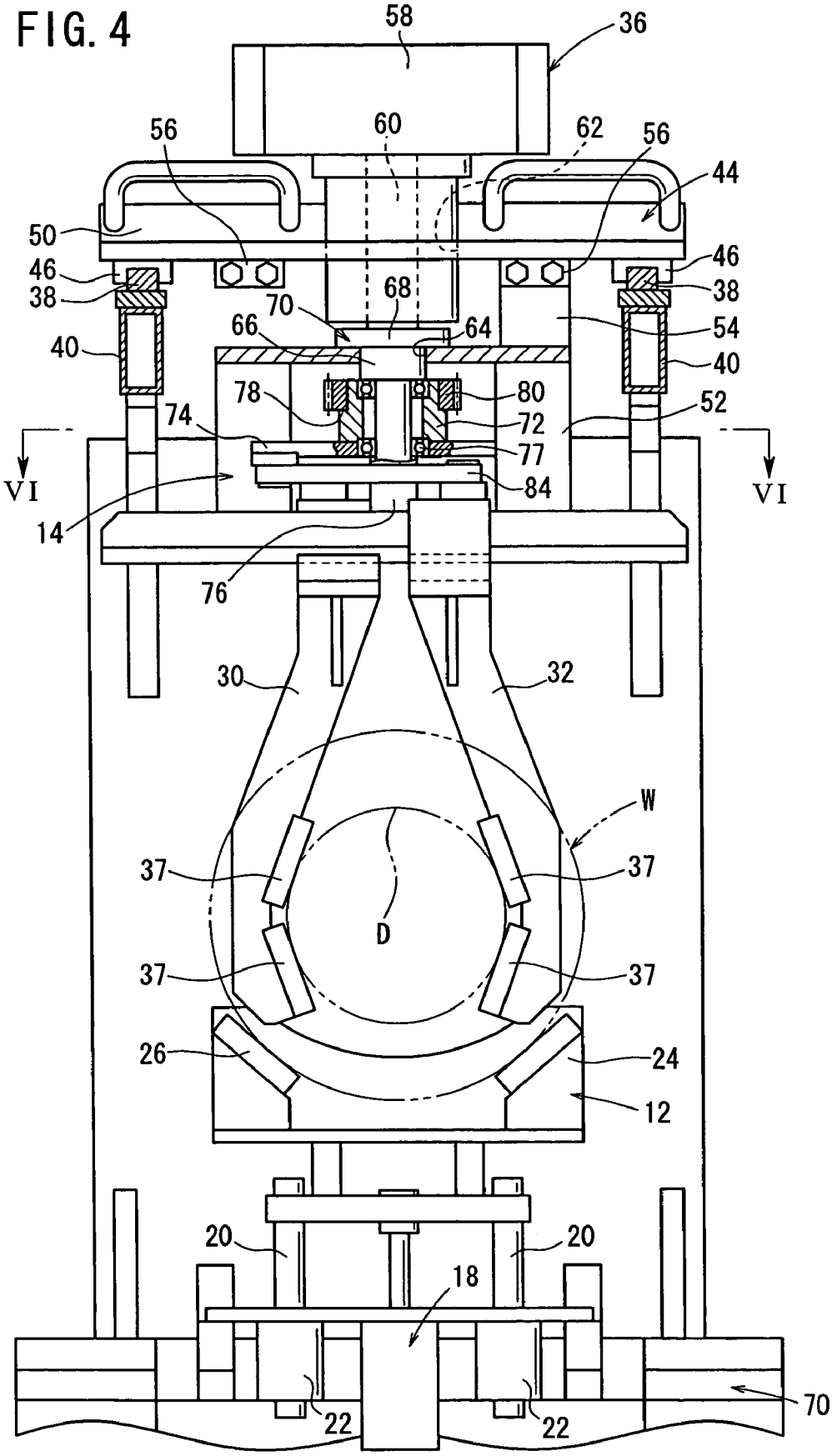
FIG. 4 is an enlarged fragmentary front elevational view of a clamp means shown in FIG. 3.

As shown in FIG. 4, the clamp means 14 has a first finger 30 and a second finger 32 which are movable toward and away from each other by an finger opening/closing means 28, an finger displacing means 34 for moving the first finger 30 and the second finger 32 forward and backward in the directions indicated by the arrow X in FIG. 2, and an finger reversing means 36 for reversing the first finger 30 and the second finger 32 to switch their positions around. Damper members 37 are mounted on workpiece contact surfaces of the first finger 30 and the second finger 32.

An elongate guide member 40 with rails 38 mounted thereon at respective left and right ends of an upper end surface thereof is mounted on an upper end of the base 17. The finger displacing means 34 comprises a finger displacing cylinder 42 mounted on an upper end face of the guide member 40.

The first finger 30 and the second finger 32 are supported on a mount base 44 held in slidable engagement with the rails 38 through slide blocks 46. The finger displacing cylinder 42 has a rod 48 coupled to the mount base 44. Therefore, when the rod 48 is moved forward or backward, the mount base 44 and hence the first finger 30 and the second finger 32 are moved forward or backward.

Figure 5:
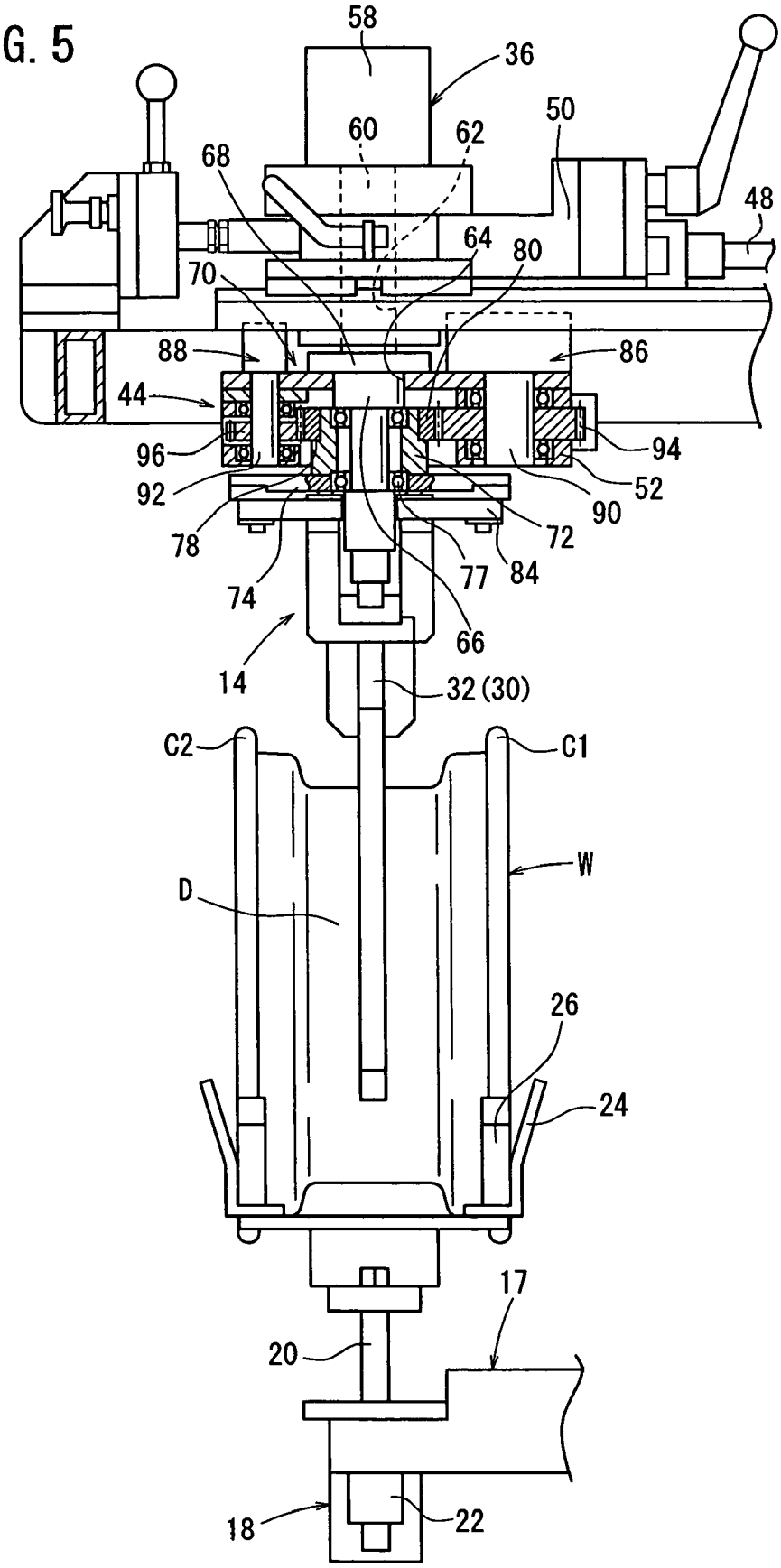
FIG. 5 is a side elevational view of the clamp means shown in FIG. 4.

As shown in FIGS. 4 and 5, the mount base 44 has a linear displacement unit 50 to which the slide blocks 46 are coupled and a rotary unit 52 that is rotatable with respect to the linear displacement unit 50. The rod 48 of the finger displacing cylinder 42 is coupled to the linear displacement unit 50.

A protrusion 54 projects from an upper end of the rotary unit 52, and a stop 56 for abutment against the protrusion 54 is mounted on a lower end of the linear displacement unit 50.

The finger reversing means 36 has a reversing actuator 58 mounted on the upper end of the mount base 44. To the reversing actuator 58, there is connected a rotational shaft 60 extending through holes 62, 64 defined respectively in the linear displacement unit 50 and the rotary unit 52. A hollow cylindrical shaft 70 having a small-diameter portion 66 and a large-diameter portion 68 is fitted over the rotational shaft 60. The small-diameter portion 66 is inserted in the through hole 64 in the rotary unit 52. The large-diameter portion 68 is coupled to the rotary unit 52 by bolts (not shown). Therefore, when the rotational shaft 60 is rotated, the hollow cylindrical shaft 70 is also rotated, reversing the rotary unit 52 and hence the first finger 30 and the second finger 32 through 180°.

The rotational shaft 60 has a lower end portion projecting from the small-diameter portion 66 of the hollow cylindrical shaft 70. The lower end portion of the rotational shaft 60 extends through a through hole defined in a hollow cylindrical member 72 of the finger opening/closing means 28 and a through hole defined in a substantially lozenge-shaped cam 74, and is rotatably supported by a bearing 76 mounted on the rotary unit 52. Bearings 77 are interposed between the linear displacement unit 50 and the hollow cylindrical member 72 and between the cam 74 and the rotatable shaft 60.

The hollow cylindrical member 72 has a recess 78 defined circumferentially in an upper end portion thereof. A first gear 80 is fitted in the recess 78. The first gear 80, the hollow cylindrical member 72, and the cam 74 are coupled to each other by bolts (not shown).

Figure 6:
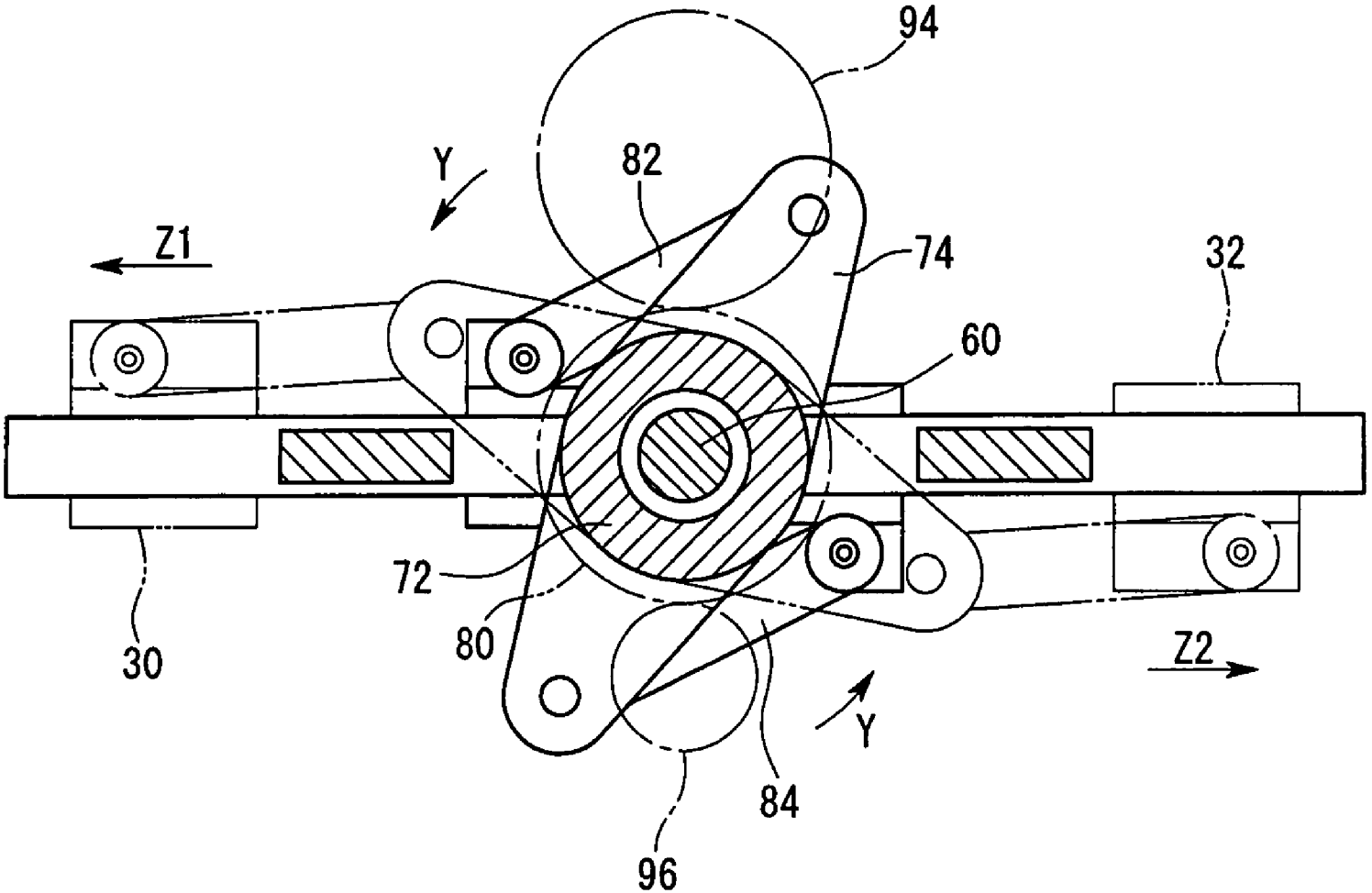
FIG. 6 is a cross-sectional view taken along line VI-VI of FIG. 4.

As can be seen from FIG. 6, which is a cross-sectional view taken along line VI-VI of FIG. 4, a first arm 82 and a second arm 84 are coupled respectively to longitudinally opposite ends of the cam 74. The first finger 30 and the second finger 32 are coupled respectively to the first arm 82 and the second arm 84.

The finger opening/closing means 28 also has a rotary actuator 86 and a rotational angle sensor 88 which are supported on the rotary unit 52. The rotary actuator 86 and the rotational angle sensor 88 have a main rotational shaft 90 and an auxiliary rotational shaft 92, respectively. A second gear 94 and a third gear 96 are fitted respectively over the main rotational shaft 90 and the auxiliary rotational shaft 92, and are held in mesh with the first gear 80.

When the main rotational shaft 90 of the rotary actuator 86 is rotated, the rotational drive force is transmitted therefrom through the second gear 94 to the first gear 80, thereby turning the cam 74 coupled to the first gear 80 in the direction indicated by the arrow Y in FIG. 6. When the cam 74 is thus turned, the first arm 82 is moved forward in the direction indicated by the arrow Z1, and the second arm 84 is moved forward in the direction indicated by the arrow Z2, spreading the first finger 30 and the second finger 32 apart from each other. That is, the first finger 30 and the second finger 32 are opened away from each other. The amount of opening between the first finger 30 and the second finger 32 is detected by the rotational angle sensor 88.

Figure 7:
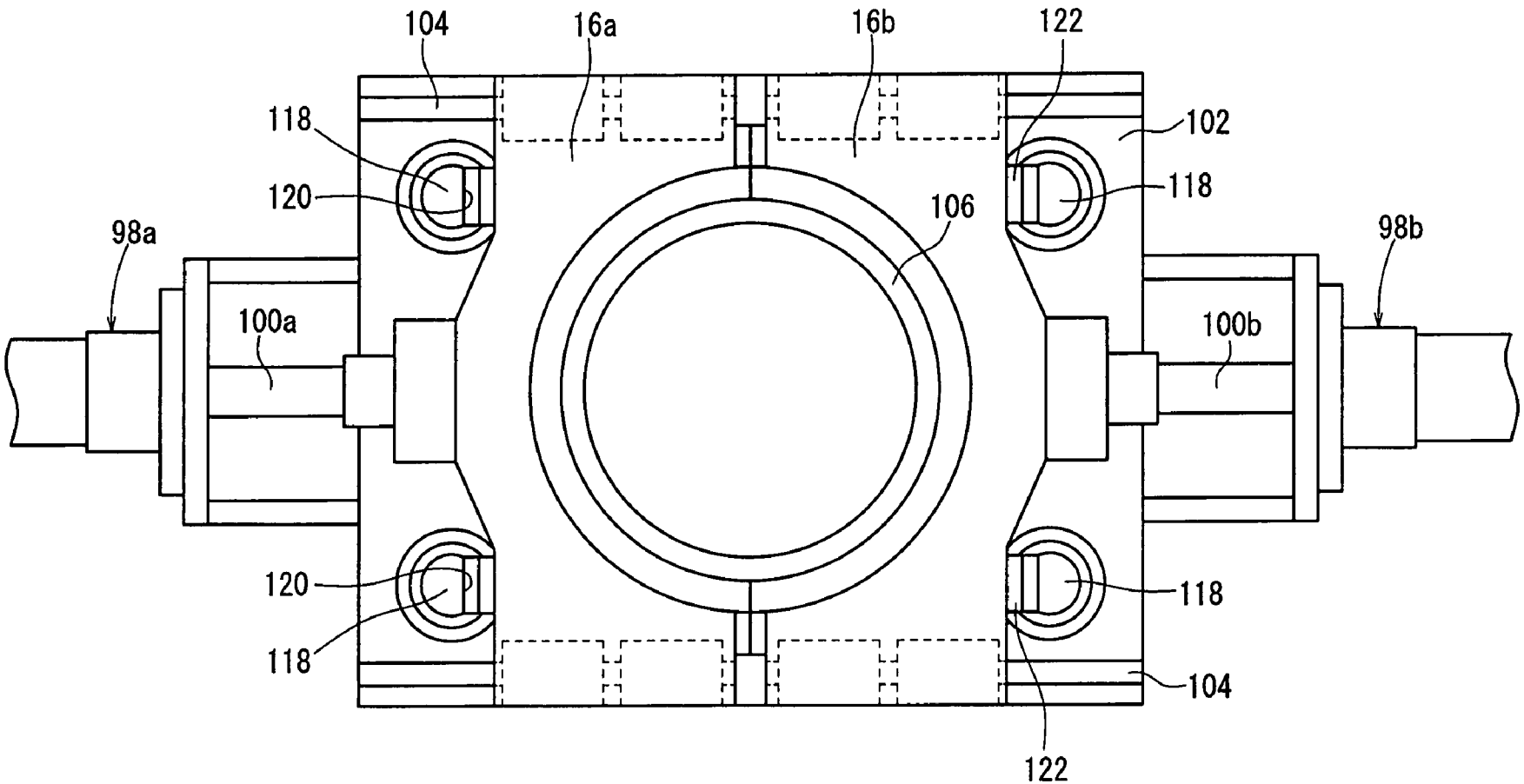
FIG. 7 is a fragmentary front elevational view showing a left first die and a right first die shown in FIG. 3 as they are closed.

As shown in FIGS. 2 and 7, the left first die 16*a* and the right first die 16*b* are connected respectively to rods 100*a*, 100*b* of a left first die cylinder 98*a* and a right first die cylinder 98*b*. When the rods 100*a*, 100*b* are moved forward or backward, the left first die 16*a* and the right first die 16*b* are moved forward or backward while they are being guided by rails 104 mounted on an end face of a planar bracket 102.

Figure 8:
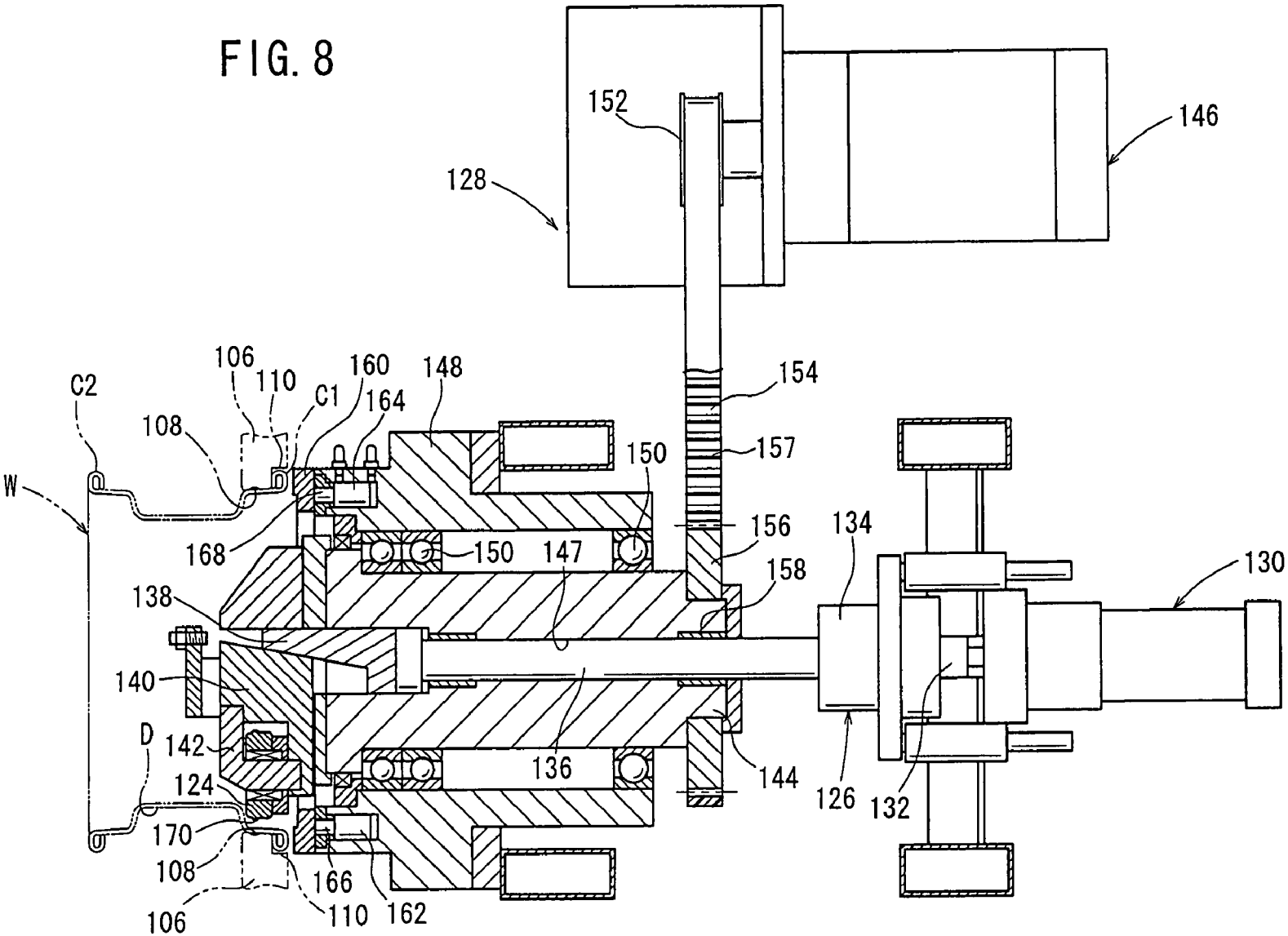
FIG. 8 is a fragmentary cross-sectional view of a displacing means for displacing a roller die toward an inner circumferential wall surface of a workpiece and a turning means for turning the roller die.

The left first die 16*a* and the right first die 16*b* have respective arcuate openings in which a support die 106 for supporting the workpiece W is removably mounted. As shown in FIG. 8, the support die 106 has a first recess 108 for forming a hump portion and a second recess 110 for supporting the curled portions C1, C2 from an outer circumferential wall surface.

Figure 9:
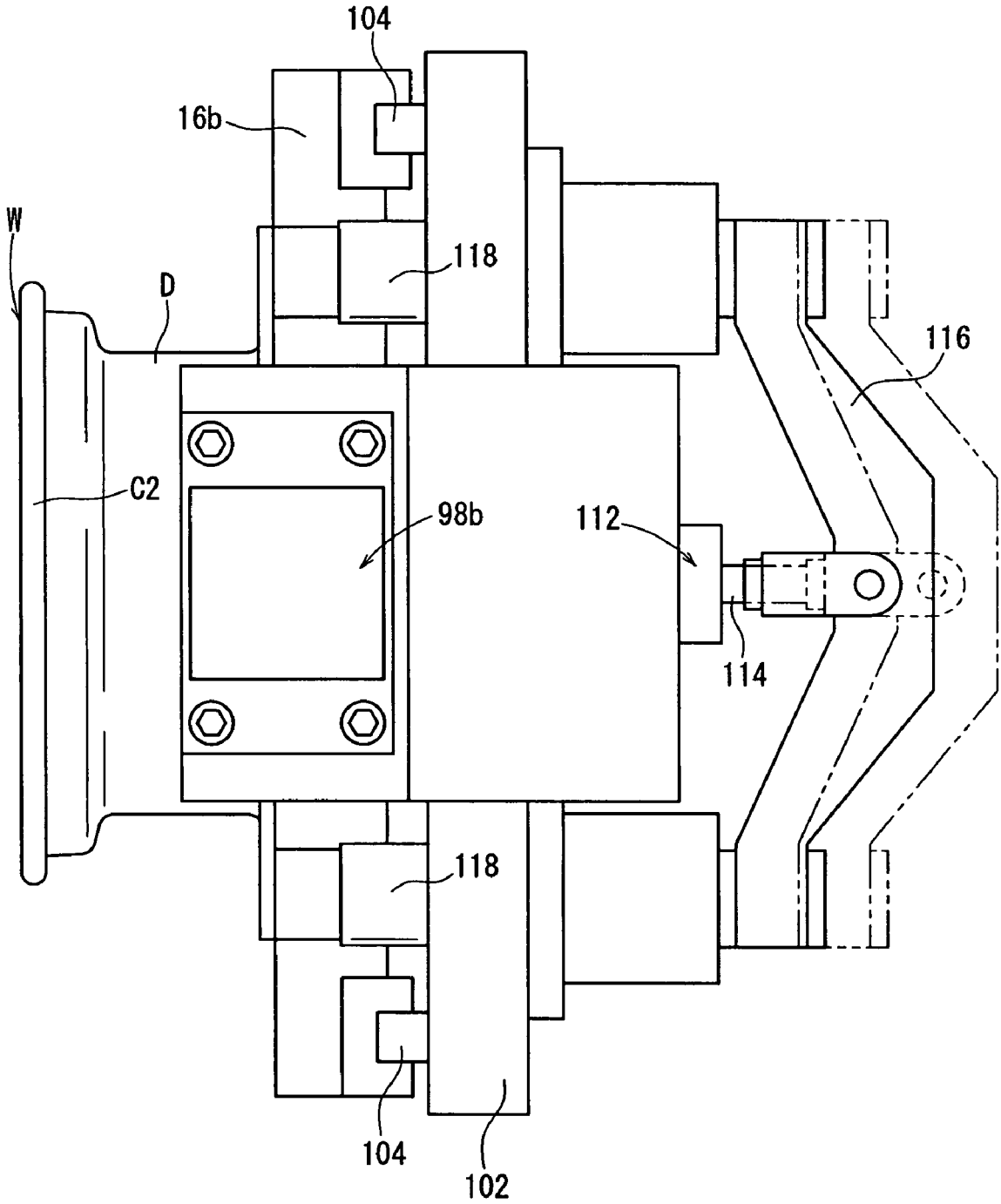
FIG. 9 is a schematic side elevational view of a positioning cylinder for positioning the left first die and the right first die shown in FIG. 7.

As shown in FIG. 9, a positioning cylinder 112 serving as a positioning means for preventing the left first die 16*a* and the right first die 16*b* that have been closed from being open is fixed to the other end face of the planar bracket 102. The positioning cylinder 112 has a rod 114 to which a bow-shaped rod displacing member 116 is connected.

The rod displacing member 116 has upper and lower ends coupled respectively to rods 118 projecting from through holes defined in the planar bracket 102. The rods 118 have recesses 120 defined in distal ends thereof. When the rods 118 are moved forward, the recesses 120 are positioned over slides 122 of the left first die 16*a* and the right first die 16*b*.

As shown in FIG. 8, the hump portion forming apparatus 10 also has a roller die 124 as a second die for forming a hump portion, a displacing means 126 for displacing the roller die 124 toward an inner circumferential wall surface of the workpiece W, and a turning means 128 for turning the roller die 124 along the circumferential direction of the workpiece W.

The displacing means 126 has a roller die displacing cylinder 130 supported on the base 17 (see FIG. 2), an elongate rod 136 as a rotational shaft coupled by a joint bracket 134 to a rod 132 of the roller die displacing cylinder 130, an engaging cam 138 fixed to the distal end of the elongate rod 136 and having a slanted surface, and a moving cam 140 displaceable toward the inner circumferential wall surface of the workpiece W when the engaging cam 138 is moved forward. A bearing (not shown) is interposed between the elongate rod 136 and the joint bracket 134.

The moving cam 140 is biased to move toward the engaging cam 138 by a helical spring (not shown). The moving cam 140 has a slanted surface held against the slanted surface of the engaging cam 138. When the elongate rod 136 is moved forward to cause the slanted surface of the engaging cam 138 to push the slanted surface of the moving cam 140, the roller die 124 that is rotatably supported on a shaft member 142 coupled to the moving cam 140 is displaced downwardly in FIG. 8, i.e., toward the inner circumferential wall surface of the workpiece W.

The turning means 128 has a rotor 144 having a hole 147 defined therein with the elongate rod 136 disposed therein, and a motor 146 for rotating the rotor 144.

Specifically, the elongate rod 136 is inserted in the hole 147 defined in the rotor 144. The rotor 144 is surrounded almost in its entirety by a fixed frame 148. Bearings 150 are interposed between the rotor 144 and the fixed frame 148.

A belt 154 is trained around a pulley 152 fixed to the distal end of the rotational shaft of the motor 146. A gear 156 is fitted over a side circumferential wall of the rotor 144 which projects from the fixed frame 148. The gear 156 is held in mesh with grooves 157 defined in the inner circumferential surface of the belt 154. Bearings 158 are interposed between the rotor 144 and the elongate rod 136. When the pulley 152 is rotated, the elongate rod 136 is also rotated by the rotor 144.

An annular support member 160 for supporting the curled portions C1, C2 from end faces thereof is mounted on the fixed frame 148. Specifically, a first support member cylinder 162 and six second support member cylinders 164 are mounted on the fixed frame 148. The annular support member 160 is mounted on the distal ends of rods 166, 168 of the first support member cylinder 162 and the second support member cylinders 164. The rods 166, 168 are synchronously movable forward and backward to cause the abutment surface of the annular support member 160 to abut simultaneously against the curled portion Cl or the curled portion C2.

The roller die 124 has on its side circumferential wall a ridge 170 disposed in positional alignment with the first recess 108 in the support die 106 in the left first die 16*a* and the right first die 16*b*.

The method of forming a hump portion according to the present embodiment, which is carried out by the hump portion forming apparatus 10 thus constructed, will be described below.

First, the first finger 30 and the second finger 32 are moved closely toward the left first die 16*a* and the right first die 16*b*, and are spaced away from each other. Specifically, the rotary actuator 86 is energized to rotate the main rotational shaft 90 and the auxiliary rotational shaft 92, making the first gear 80 rotate via the second gear 94 and the third gear 96 that are fitted respectively over the main rotational shaft 90 and the auxiliary rotational shaft 92. The hollow cylindrical member 72 is rotated to turn the cam 74 in the direction indicated by the arrow Y in FIG. 6. As a result, the first arm 82 and the second arm 84 are moved forward in the respective directions indicated by the arrows Z1, Z2, displacing the first finger 30 and the second finger 32 away from each other. Stated otherwise, the first finger 30 and the second finger 32 are spaced away from each other. As described above, the amount of opening between the first finger 30 and the second finger 32 is detected by the rotational angle sensor 88 (see FIG. 5).

The placement table lifting and lowering cylinder 18 is actuated to position the placement table 12 in a top dead center. Then, the workpiece (rim) W is placed on the placement table 12. At this time, the longitudinal direction of the workpiece W and the longitudinal direction of the wheel rim hump portion forming apparatus 10 are held in alignment with each other. That is, the workpiece W is placed such that the curled portion C1 at one end of the workpiece W faces the left first die 16*a* and the right first die 16*b* of the wheel rim hump portion forming apparatus 10.

Figure 10:
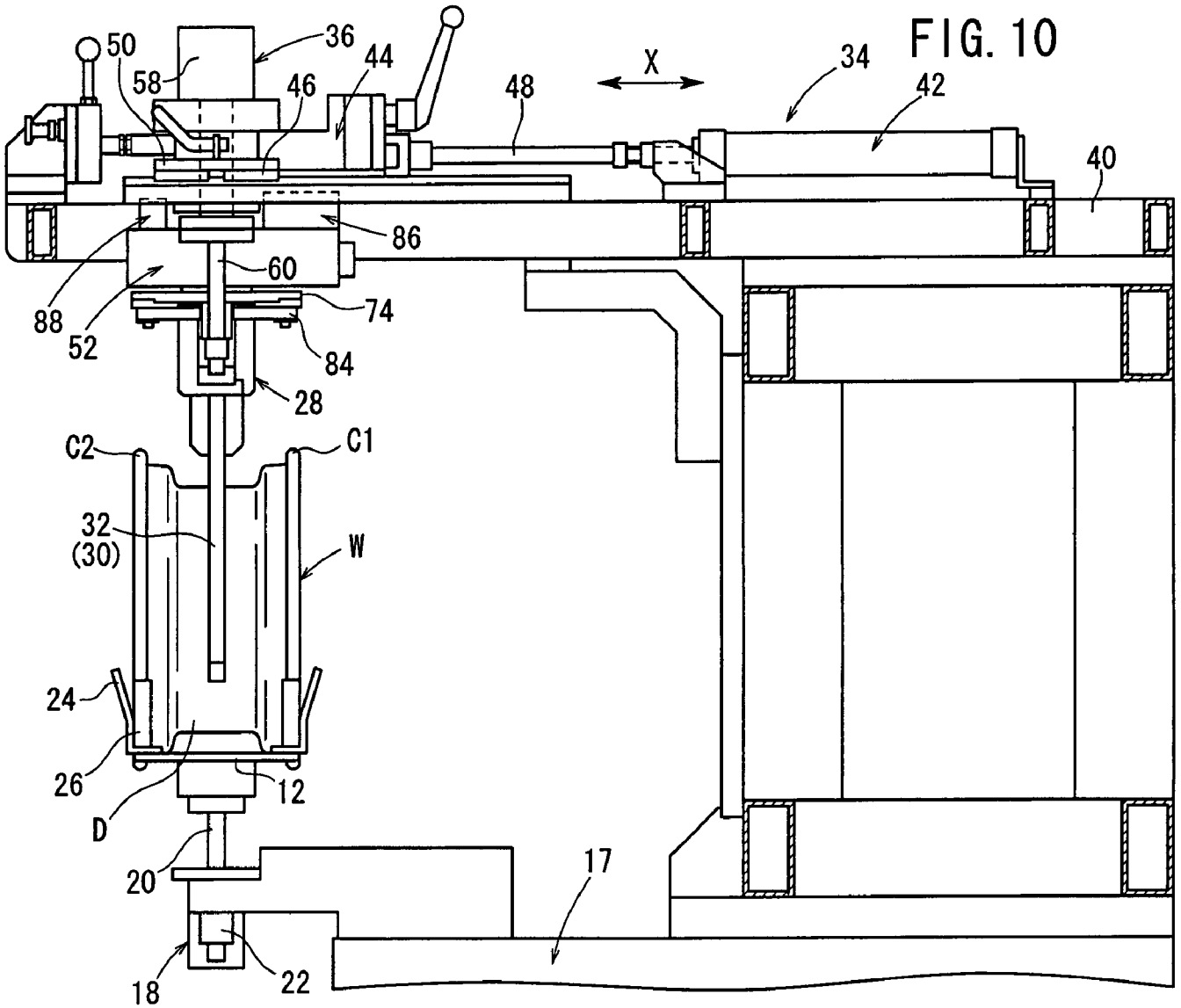
FIG. 10 is a fragmentary schematic side elevational view showing the workpiece placed on a placement table and gripped by a first finger and a second finger.

The finger displacing cylinder 42 is actuated to move the rod 48 thereof forward to move the mount base 44 forward along the rails 38, thereby displacing the first finger 30 and the second finger 32 to the drop portion D of the workpiece W. Thereafter, the main rotatable shaft 90 of the rotary actuator 86 is reversed to displace the first finger 30 and the second finger 32 toward each other. Finally, the first finger 30 and the second finger 32 grip the drop portion D of the workpiece W as shown in FIG. 10. The placement table lifting and lowering cylinder 18 is then actuated to lower the placement table 12. The workpiece W is released from the placement table 12 and is gripped only by the first finger 30 and the second finger 32.

Then, the finger displacing cylinder 42 is actuated to retract the rod 48 to retract the first finger 30 and the second finger 32, thereby retracting the curled portion C1 of the workpiece W to the position of the left first die 16*a* and the right first die 16*b*.

Then, the right first die cylinder 98*b* is actuated to move the rod 100*b* forward toward the workpiece W, bringing the curled portion C1 closely to the second recess 110 of the support die 106 in the right first die 16*b* that has been displaced by being guided by the rails 104 on the planar bracket 102, and bringing the other portion of the support die 106 closely to the side circumferential wall of the workpiece W. Finally, the rod 100*b* is moved forward maximally to bring the right first die 16*b* to a forward end position.

Similarly, the left first die cylinder 98*a* is actuated to move the rod 100*a* forward toward the workpiece W. The second recess 110 of the support die 106 in the left first die 16*a* that has been displaced by being guided by the rails 104 is brought closely to the curled portion C1, and the other portion of the support die 106 is brought closely to the side circumferential wall of the workpiece W.

The rod 100*a* is moved forward under a force which is about one-half of the drive force applied to the rod 100*b*. Therefore, the left first die 16*a* stops when the end face of the support die 106 in the left first die 16*a* abuts against the end face of the support die 106 in the right first die 16*b* that has been waiting in the forward end position. According to the present embodiment, consequently, the rod 100*a* stops with respect to the forward end position of the right first die 16*b* at the time the rod 100*b* is moved forward maximally, whereupon the left first die 16*a* stops and is positioned. When the left first die 16*a* is positioned, the closing of these dies is finished, supporting the curled portion C1 from the side circumferential wall surface thereof and supporting the side circumferential wall of the workpiece W.

According to the present embodiment, the right first die 16*b* and the left first die 16*a* are individually operated. If the workpiece W is shifted closer to the right first die 16*b*, it is pressed by the right first die 16*b* which is moved forward earlier and displaced to the forward end position of the right first die 16*b*. The workpiece W is supported and positioned by the left first die 16*a* in the forward end position. Conversely, if the workpiece W is shifted closer to the left first die 16a, it is pressed by the left first die 16*a* which is moved forward subsequently and displaced to the right first die 16*b* which has completed the forward movement and has been waiting in the forward end position. The workpiece W is supported and positioned by the right first die 16*b* in the forward end position. The workpiece W is thus reliably be positioned in the predetermined position. Stated otherwise, the workpiece W is prevented from being positionally displaced.

Then, the first support member cylinder 162 and the six second support member cylinders 164 are actuated to move the rods 166, 168 forward until the annular support member 160 abuts simultaneously against the end face of the curled portion C1. Since the annular support member 160 abuts simultaneously against the end face of the curled portion C1, the longitudinal direction of the workpiece W and the longitudinal direction of the elongate rod 136 are held in alignment with each other. That is, the workpiece W is prevented from being inclined with respect to the elongate rod 136 and the roller die 124.

Then, the positioning cylinder 112 is retracted toward the planar bracket 102. The rod 118 projects further from the through hole in the planar bracket 102. The recesses of the rods 118 are slid against and then placed over the slides 122 of the left first die 16*a* and the right first die 16*b*. The left first die 16*a* and the right first die 16*b* are now positioned and fixed for protection against being open.

Figure 11:
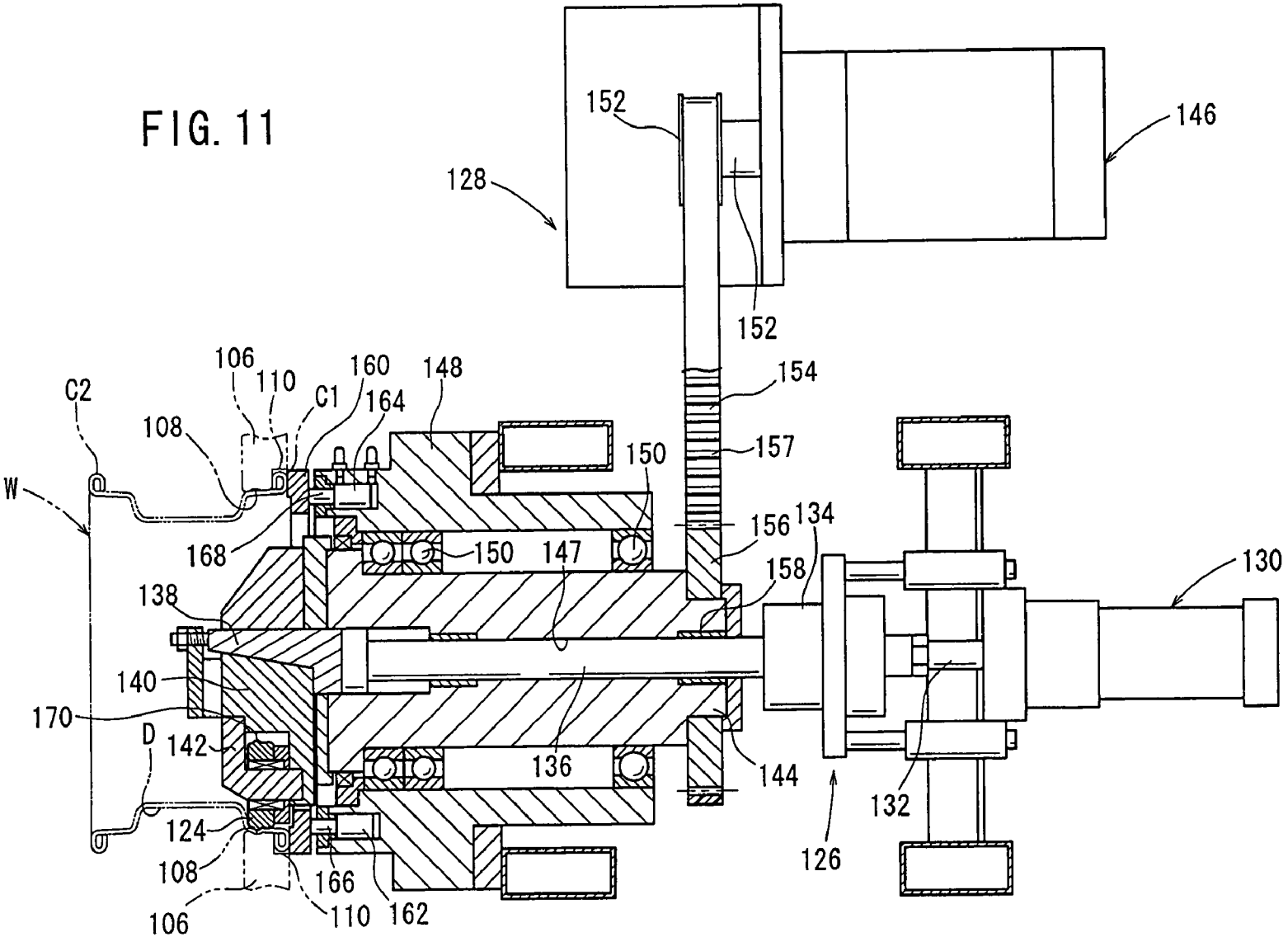
FIG. 11 is a fragmentary cross-sectional view showing the roller die displaced toward the inner circumferential wall surface of the workpiece and pressed thereagainst to form a raised portion.
Figure 12:
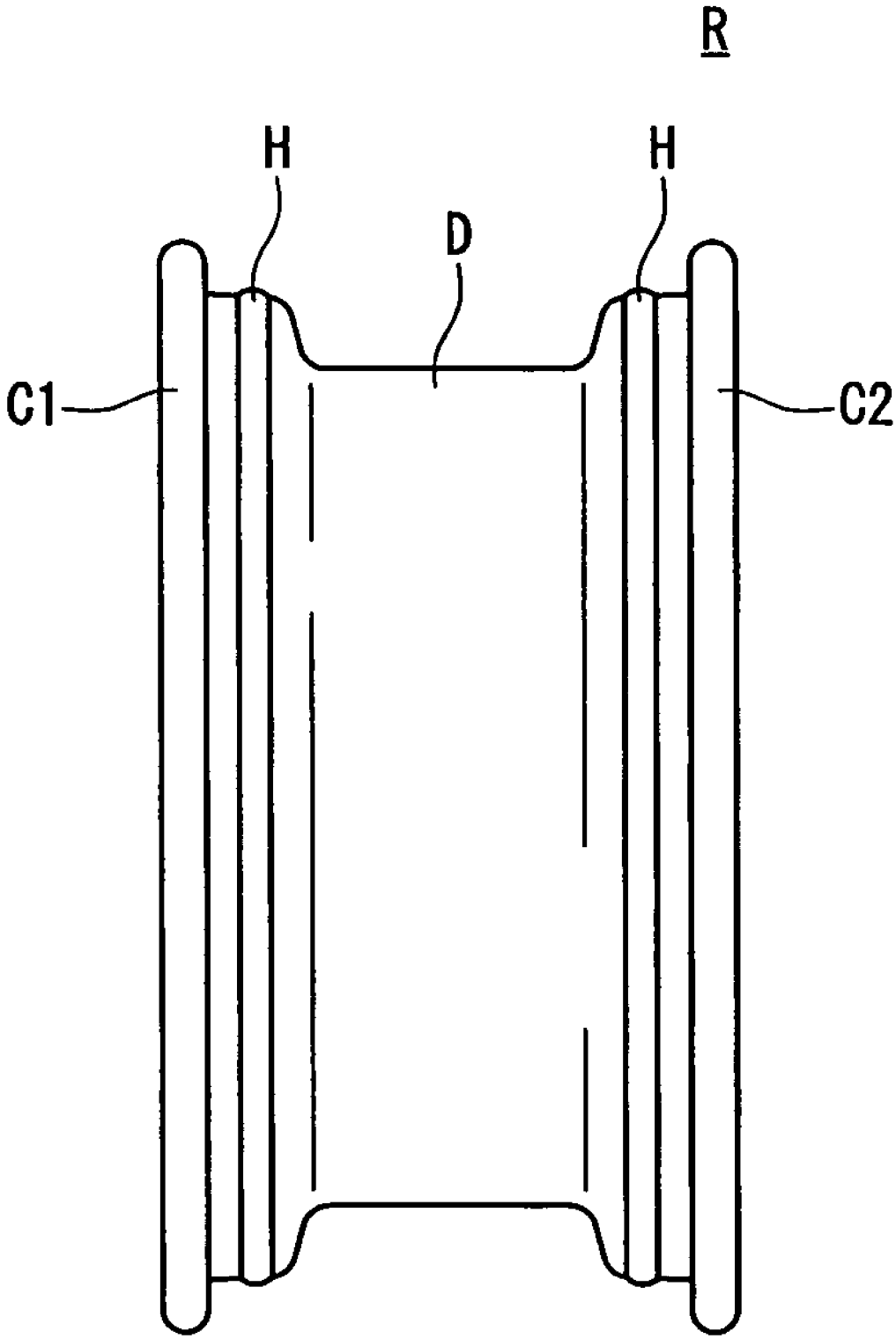
FIG. 12 is a schematic side elevational view of an overall vehicular wheel rim with hump portions.

Then, the rod 132 of the roller die displacing cylinder 130 is moved forward to make the elongate rod 136 move forward via the joint bracket 134. The slanted surface of the engaging cam 138 slides against the slanted surface of the moving cam 140, which is displaced toward the inner circumferential wall surface of the workpiece W. As a result, as shown in FIG. 11, the ridge 170 of the roller die 124 is brought into abutment against the inner circumferential wall surface of the workpiece W. The continued displacement of the roller die 124 depresses the inner circumferential wall surface and raises the outer circumferential wall surface of the workpiece W by way of plastic deformation, forming a raised portion. The raised position is accommodated in the first recess 108 of the support die 106 in the left first die 16*a* and the right first die 16*b*.

Then, the pulley 152 on the distal end of the rotational shaft of the motor 146 is rotated, starting to rotate the belt 154 and the gear 156. The rotor 144 is rotated, making the elongate rod 136 rotate via the bearing 158. Since the bearings 150 are interposed between the rotor 144 and the fixed frame 148, the fixed frame 148 is not rotated. The same relationship applies to the elongate rod 136 and the joint bracket 134.

When the elongate rod 136 is rotated, the engaging cam 138 and the moving cam 140 are also rotated. The roller die 124 coupled to the moving cam 140 is turned along the inner circumferential wall surface of the workpiece W, continuously depressing the inner circumferential wall surface of the workpiece W and continuously raising the outer circumferential wall surface of the workpiece W. When the outer circumferential wall surface is thus continuously raised, a hump portion H is formed as projecting from the outer circumferential wall surface.

According to the present embodiment, after the workpiece W is positioned in place by being pressed from the end face and the outer circumferential wall surface thereof, the inner circumferential wall surface is pressed by the roller die 124 to form the hump portion H. Consequently, the hump portion H can be formed at a position that is spaced a predetermined distance from the curled portion C1.

In this case, the inner circumferential wall surface of the workpiece W is pressed by the ridge 170 of the roller die 124, and the workpiece W is plastically deformed by having the material of the workpiece W pressed by the ridge 170 enter the first recess 108 of the support die 106 in the left first die 16*a* or the right first die 16*b*. Consequently, the radii of curvature of the inner circumferential wall surface and the outer circumferential wall surface of the workpiece W in the hump portion H formed are kept in a predetermined numerical range. Stated otherwise, the hump portion H is of good dimensional accuracy.

Since the workpiece W is prevented from being inclined by abutment against the annular support member 160, the hump portion H has its profile extending along the circumferential direction of the workpiece W.

Furthermore, the left first die 16*a* is closed after the right first die 16*b* is positioned in the forward end position. Thus, even if the workpiece W is shifted closer to the left first die 16*a* or the right first die 16*b*, the workpiece W is finally displaced to the forward end position of the right first die 16*b* and positioned in the forward end position. Therefore, the roller die 124 is turned along the circumferential direction of the inner circumferential wall surface of the workpiece W without being positionally shifted, so that the hump portion H is free from height variations and radius-of-curvature variations.

After the hump portion H is formed on one end of the workpiece W, the workpiece W is reversed. Specifically, the workpiece W is released from the roller die 124 by a process which is the reversal of the above process. After the rod 114 of the positioning cylinder 112 is embedded in the through hole of the left first die 16*a* and the right first die 16*b*, the left first die 16*a* and the right first die 16*b* are opened. The reversing actuator 58 is energized to rotate the rotational shaft 60 thereof.

When the rotational shaft 60 rotates, the hollow cylindrical shaft 70 fitted over the rotational shaft 60 rotates. The rotary unit 52 that is coupled to the hollow cylindrical shaft 70 is rotated, reversing the first finger 30 and the second finger 32 which are supported by the rotary unit 52. Though the cam 74 rotates at this time, it is not turned in the direction indicated by the arrow Y (see FIG. 6). The first finger 30 and the second finger 32 are thus not spaced away from each other. Stated otherwise, the workpiece W remains gripped even when the rotary unit 52 is reversed. The reversed rotary unit 52 stops when the protrusion 54 abuts against the stop 56 of the linear displacement unit 50.

After the first finger 30 and the second finger 32 are reversed to reverse the workpiece W, a process which is the same as the above process is performed to produce a rim R having a hump portion H of good dimensional accuracy on the remaining other end of the workpiece W.

If a hump portion H is to be formed on a workpiece longer than the workpiece W shown in FIG. 2, for example, then the support frame 26 may be detached from the placement table 12.

If a hump portion H is to be formed on a workpiece whose opening diameter is different from the workpiece W shown in FIG. 2, then the support die 106 in the left first die 16*a* and the right first die 16*b* may be replaced with a support die having a dimension depending on the opening diameter.

In the above embodiment, the right first die 16*b* is operated first. However, the left first die 16*a* may be operated first.

The invention claimed is:

1. A method of forming a wheel rim hump portion along a circumferential direction on an outer circumferential wall surface of a vehicular wheel rim gripped by gripping means, comprising the steps of:

supporting said vehicular wheel rim from the outer circumferential wall surface thereof with a first die surrounding the vehicle wheel rim and having a recess, and pressing said vehicular wheel rim from an inner circumferential wall surface thereof with a ridge disposed on a second die coupled to a rotational shaft at a position corresponding to said recess to raise the outer circumferential wall surface of said vehicular wheel rim; and rotating said rotational shaft to displace said ridge along the circumferential direction on the inner circumferential wall surface of said vehicular wheel rim, thereby raising said outer circumferential wall surface along the circumferential direction to form a hump portion.

2. A method according to claim 1, wherein said first die has another recess different from said recess, and when said vehicular wheel rim is supported from said outer circumferential wall surface thereof, a curled portion on an end of said vehicular wheel rim is accommodated and supported in said other recess.

3. A method according to claim 1 or 2, wherein a roller having said ridge projecting from a side circumferential wall thereof is used as said second die.

4. An apparatus for forming a wheel rim hump portion along a circumferential direction on an outer circumferential wall surface of a vehicular wheel rim gripped by gripping means, comprising:

a placement table for placing said vehicular wheel rim thereon;

a first die for surrounding the vehicle wheel rim and having a recess, for supporting said vehicular wheel rim from an outer circumferential wall surface thereof;

a second die coupled to a rotational shaft and having a ridge at a position corresponding to said recess; and rotating means for rotating said rotational shaft;

wherein said vehicular wheel rim is pressed from an inner circumferential wall surface thereof with said ridge of said second die, and plastically deformed material of said vehicular wheel rim is caused to enter said recess of said first die to raise said outer circumferential wall surface of said vehicular wheel rim; and wherein said rotational shaft is rotated to displace said ridge along the circumferential direction on the inner circumferential wall surface of said vehicular wheel rim, thereby raising said outer circumferential wall surface along the circumferential direction to form a hump portion.

5. An apparatus according to claim 4, wherein said first die has another recess different from said recess, and when said vehicular wheel rim is supported from said outer circumferential wall surface thereof, a curled portion on an end of said vehicular wheel rim is supported in said other recess.

6. An apparatus according to claim 4 or 5, wherein said second die comprises a roller having said ridge projecting from a side circumferential wall thereof.

7. An apparatus according to claim 6, further comprising reversing means for reversing said gripping means.

8. An apparatus according to claim 4 or 5, further comprising reversing means for reversing said gripping means.

9. An apparatus for forming a wheel rim hump portion along a circumferential direction on an outer circumferential wall surface of a vehicular wheel rim gripped by gripping means, comprising:

a placement table for placing said vehicular wheel rim thereon;

a first die having two movable plates each having a recess, said movable plates being movable independently of each other;

a second die coupled to a rotational shaft and having a ridge at a position corresponding to said recess; and rotating means for rotating said rotational shaft;

wherein a curled portion formed by bending an end of said vehicular wheel rim, is moved to a position of said first die while said first die is being open, thereafter one of said movable plates of said first die is closed, and further thereafter the remaining movable plate is closed to close said first die for thereby supporting the outer circumferential wall surface of said vehicular wheel rim, wherein while the outer circumferential wall surface is supported, said vehicular wheel rim is pressed from an inner circumferential wall surface thereof with said ridge of said second die, and plastically deformed material of said vehicular wheel rim is caused to enter said recess of said first die to raise said outer circumferential wall surface of said vehicular wheel rim; and wherein said rotational shaft is rotated to displace said ridge along the circumferential direction on the inner circumferential wall surface of said vehicular wheel rim, thereby raising said outer circumferential wall surface along the circumferential direction to form a hump portion.

10. An apparatus according to claim 9, further comprising fixing means for positioning and fixing said first die which is closed.

11. An apparatus according to claim 9 or 10, wherein a pressing force of said one of said movable plates is greater than a pressing force of said remaining movable plate.

12. An apparatus for forming a wheel rim hump portion along a circumferential direction on an outer circumferential wall surface of a vehicular wheel rim gripped by gripping means, comprising:

a placement table for placing said vehicular wheel rim thereon;

a first die having a recess, for supporting said vehicular wheel rim from an outer circumferential wall surface thereof;

a second die coupled to a rotational shaft and having a ridge at a position corresponding to said recess;

rotating means for rotating said rotational shaft;

a support member for supporting a curled portion from an end face thereof, said curled portion being formed on an end of said vehicular wheel rim; and support member displacing means for displacing said support member, wherein said support member is held in abutment against the end face of said curled portion, and the outer circumferential wall surface of said vehicular wheel rim is supported with said first die, and thereafter said vehicular wheel rim is pressed from an inner circumferential wall surface thereof with said ridge of said second die, and plastically deformed material of said vehicular wheel rim is caused to enter said recess of said first die to raise said outer circumferential wall surface of said vehicular wheel rim; and wherein said rotational shaft is rotated to displace said ridge along the circumferential direction on the inner circumferential wall surface of said vehicular wheel rim, thereby raising said outer circumferential wall surface along the circumferential direction to form a hump portion.

* * * * *